US006821180B2

(12) United States Patent
Kimura et al.

(10) Patent No.: US 6,821,180 B2
(45) Date of Patent: Nov. 23, 2004

(54) ELECTRON SOURCE MANUFACTURING APPARATUS

(75) Inventors: Akihiro Kimura, Kanagawa (JP); Kazuhiro Ohki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 362 days.

(21) Appl. No.: 09/888,594

(22) Filed: Jun. 26, 2001

(65) Prior Publication Data

US 2002/0022430 A1 Feb. 21, 2002

(30) Foreign Application Priority Data

Jun. 30, 2000 (JP) ..... 2000-198018
Jun. 21, 2001 (JP) ..... 2001-188374

(51) Int. Cl.[7] ..... H01J 9/06; H01J 9/10; H01J 9/16; H01J 9/46; H05B 33/10

(52) U.S. Cl. ..... 445/62; 445/5; 445/6; 445/63

(58) Field of Search ..... 445/5, 6, 62, 63

(56) References Cited

U.S. PATENT DOCUMENTS 6,135,839 A 10/2000 Iwase et al. ..... 445/24
6,169,356 B1 1/2001 Ohnishi et al. ..... 313/495
6,582,268 B1 * 6/2003 Jindai et al. ..... 445/6

FOREIGN PATENT DOCUMENTS

| | | |
|---|---|---|
| EP | 0908916 A1 | 4/1999 |
| EP | WO 00/14761 | 3/2000 |
| JP | 7235255 | 9/1995 |
| JP | 11-195374 | 7/1999 |
| JP | 2000-173453 | 6/2000 |
| JP | 2000-311594 | 11/2000 |

* cited by examiner

*Primary Examiner*—Nimeshkumar D. Patel
*Assistant Examiner*—Sumati Krishnan
(74) *Attorney, Agent, or Firm*—Fitzpatrick, Cella, Harper & Scinto

(57) ABSTRACT

This invention provides an electron source manufacturing apparatus and manufacturing method which facilitate downsizing and operation and are suitable for mass production. The electron source manufacturing apparatus includes a support which supports a substrate having conductors formed on it and has a means for adjusting the temperature of the substrate, a vessel which has a gas inlet port and gas exhaust port and covers a partial region on the surface of the substrate, an unit for introducing and exhausting gas into and from the vessel, and an unit for applying a voltage to the conductors. The support has a groove.

16 Claims, 12 Drawing Sheets

| GAP SIZE | TEMPERATURE DISTRIBUTION |
|---|---|
| INNER SIDE 1mm, OUTER SIDE 15mm | 9.5℃ |
| INNER SIDE 2mm, OUTER SIDE 15mm | 6.2℃ |
| INNER SIDE 1mm, OUTER SIDE 25mm | 9.1℃ |
| INNER SIDE 2mm, OUTER SIDE 25mm | 5.7℃ |
| NO GAP | 19.1℃ |

ELECTRON SOURCE MANUFACTURING APPARATUS

BACKGROUND OF THE INVENTION

1. Field of the Invention

The present invention relates to an electron source manufacturing apparatus.

2. Related Background Art

Conventionally, electron-emitting devices are mainly classified into two types of devices: thermionic cathodes and cold cathodes. The cold cathodes include a field emission type electron-emitting device, metal/insulator/metal type electron-emitting device, and surface conduction electron-emitting device.

The surface conduction electron-emitting device utilizes the phenomenon that electrons are emitted by flowing a current through a small-area thin film formed on a substrate parallel to the film surface. Many proposals have been made for a surface conduction electron-emitting device having a new structure and its applications. For example, a basic structure or manufacturing method is disclosed in Japanese Patent Application Laid-Open No. 7-235255.

Such an electron source and an image-forming apparatus using the electron source are manufactured as follows.

According to the first manufacturing method, an electron source substrate on which a plurality of units each made up of a conductive film and a pair of device electrodes connected to the conductive film, and wiring lines connected to the plurality of units are laid out is formed. The entire electron source substrate is set in a vacuum chamber. After the vacuum chamber is evacuated, the "forming step" of applying a voltage to each unit via an external terminal to form a gap in the conductive film of the unit is performed. The "activation step" of introducing organic substance-containing gas into the vacuum chamber and applying a voltage to each unit again via the external terminal under the organic substance-containing atmosphere to deposit carbon or a carbon compound near the gap is executed, thereby changing each unit into an electron-emitting device. The resultant electron source substrate and a substrate bearing phosphors are joined to each other via a support frame, completing an image-forming apparatus.

According to the second method, an electron source substrate on which a plurality of units each made up of a conductive film and a pair of device electrodes connected to the conductive film, and wiring lines connected to the plurality of units are laid out is formed. The obtained electron source substrate and a substrate bearing phosphors are bonded to each other via a support frame, forming the panel of an image-forming apparatus. Then, the "forming step" of evacuating the interior of the panel via the exhaust pipe of the panel and applying a voltage to each unit via the external terminal of the panel to complete each unit is performed. The "activation step" of introducing organic substance-containing gas into the panel via the exhaust pipe and applying a voltage to each unit again via the external terminal under the organic substance-containing atmosphere to deposit carbon or a carbon compound near the gap is executed, thereby changing each unit into an electron-emitting device. The exhaust pipe connected to the panel is sealed, completing an image-forming apparatus.

SUMMARY OF THE INVENTION

Especially the first manufacturing method requires a larger-size vacuum chamber and higher-vacuum exhaust device as the electron source substrate becomes larger in size. The second manufacturing method takes a long time for evacuation from the internal space of the panel of the image-forming apparatus and introduction of organic substance-containing gas into the internal space of the panel.

It is an object of the present invention to provide an electron source manufacturing apparatus which can be easily downsized and operated.

It is another object of the present invention to provide an electron source manufacturing method which can increase the manufacturing speed and is suitable for mass production.

It is still another object of the present invention to provide an electron source manufacturing apparatus and manufacturing method capable of manufacturing an electron source excellent in electron emitting characteristics.

According to the present invention, there is provided an electron source manufacturing apparatus comprising a support which supports a substrate having a conductor formed thereon and has means for adjusting a temperature of the substrate, a vessel which has a gas inlet port and a gas exhaust port and covers part of the substrate, means for introducing and exhausting gas into and from the vessel, and means for applying a voltage to the conductor, wherein a gap or groove is formed at a predetermined portion of the support.

According to the present invention, there is provided an electron source manufacturing apparatus comprising a support which supports a substrate having a plurality of conductors each comprising a pair of electrodes and a conductive film formed between the electrodes, a vessel which covers part of the substrate, means for introducing and exhausting gas into and from a space defined by the vessel and the substrate, and means for applying a voltage to each conductor, wherein the support has a groove in a surface in contact with the substrate.

The present invention achieves downsizing of the electron source manufacturing apparatus and high operability for electrical connection to a power supply or the like. In addition, the degree of freedom of design such as the size and shape of the vessel increases. Gas can be introduced/exhausted into/from the vessel within a short time, thus shortening the manufacturing time. The reproducibility and uniformity of the electron-emitting characteristics of a manufactured electron source can be improved.

DETAILED DESCRIPTION OF THE PREFERRED EMBODIMENTS

Preferred embodiments of the present invention will be described in detail below with reference to the accompanying drawings.

Figure 1A:
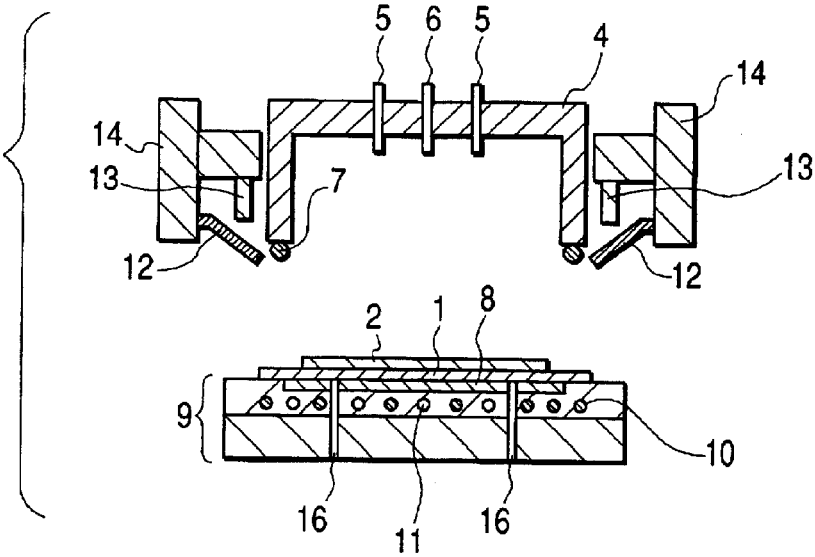
FIGS. 1A, 1B and 1C are sectional views sequentially showing an operation in an embodiment of the present invention.
Figure 1B:
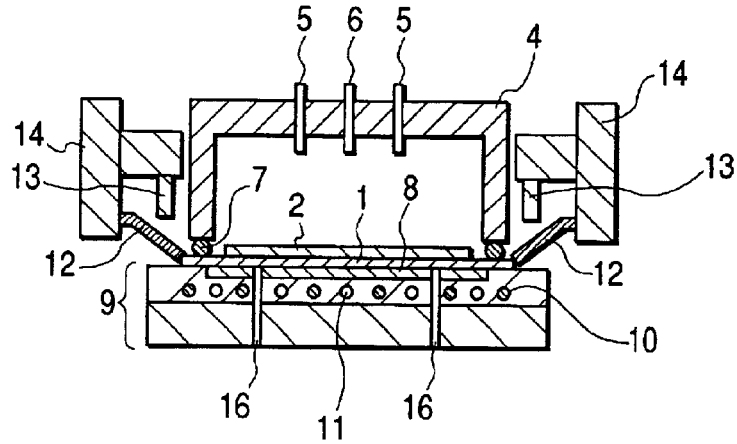
Figure 1C:
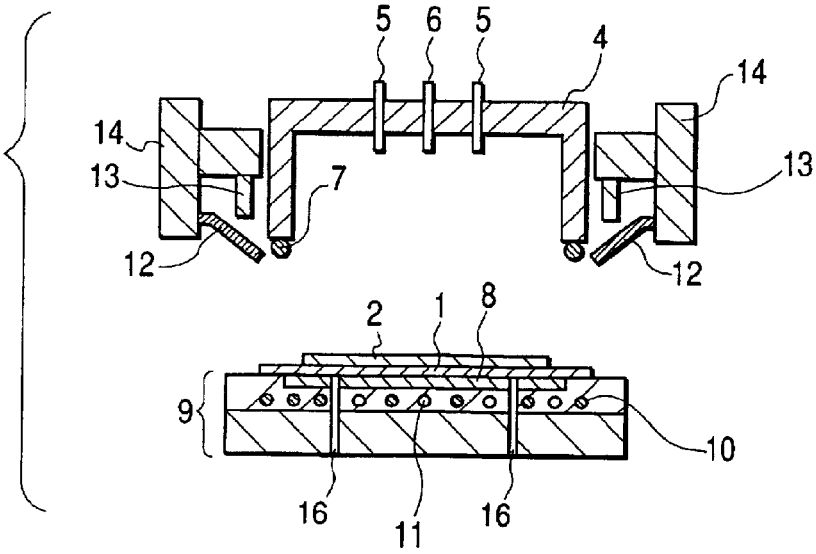
Figure 2:
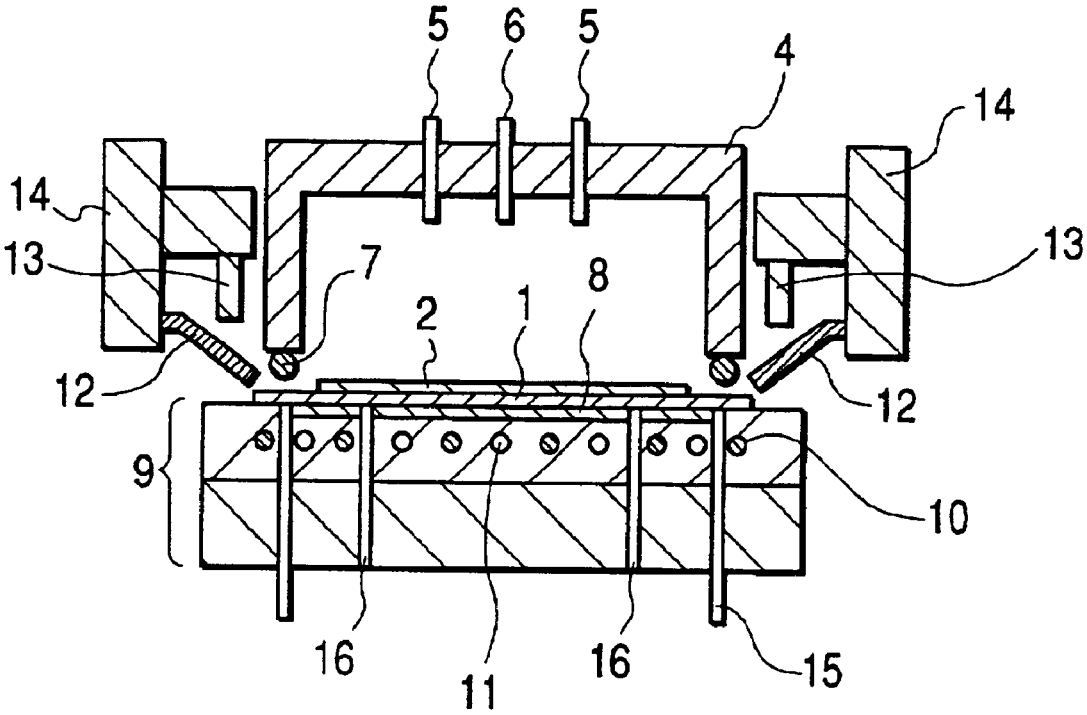
FIG. 2 is a sectional view showing an apparatus in the embodiment of the present invention.
Figure 3:
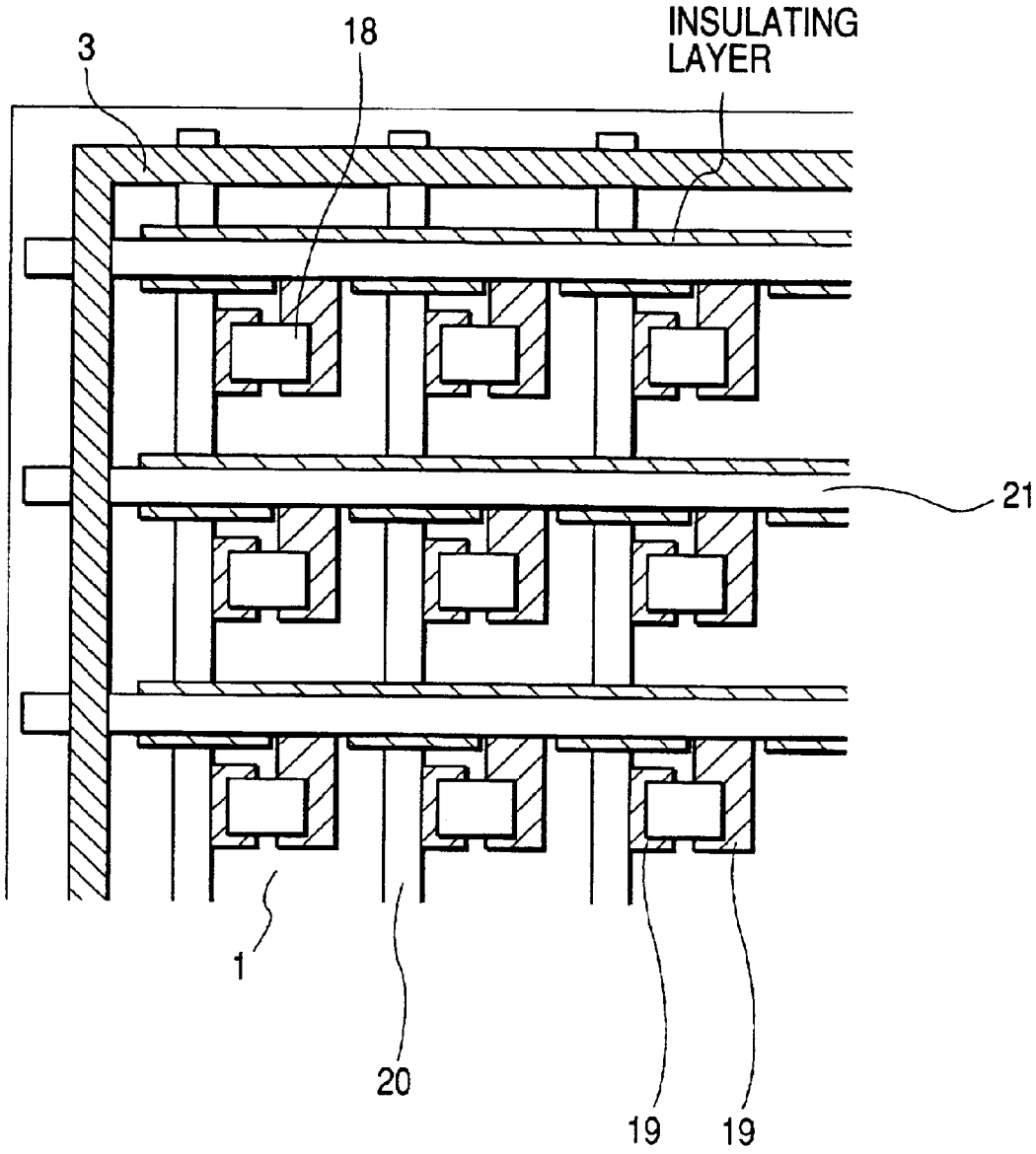
FIG. 3 is a plan view showing an electron source substrate before formation of an electron emitting portion in the embodiment of the present invention.
Figure 4:
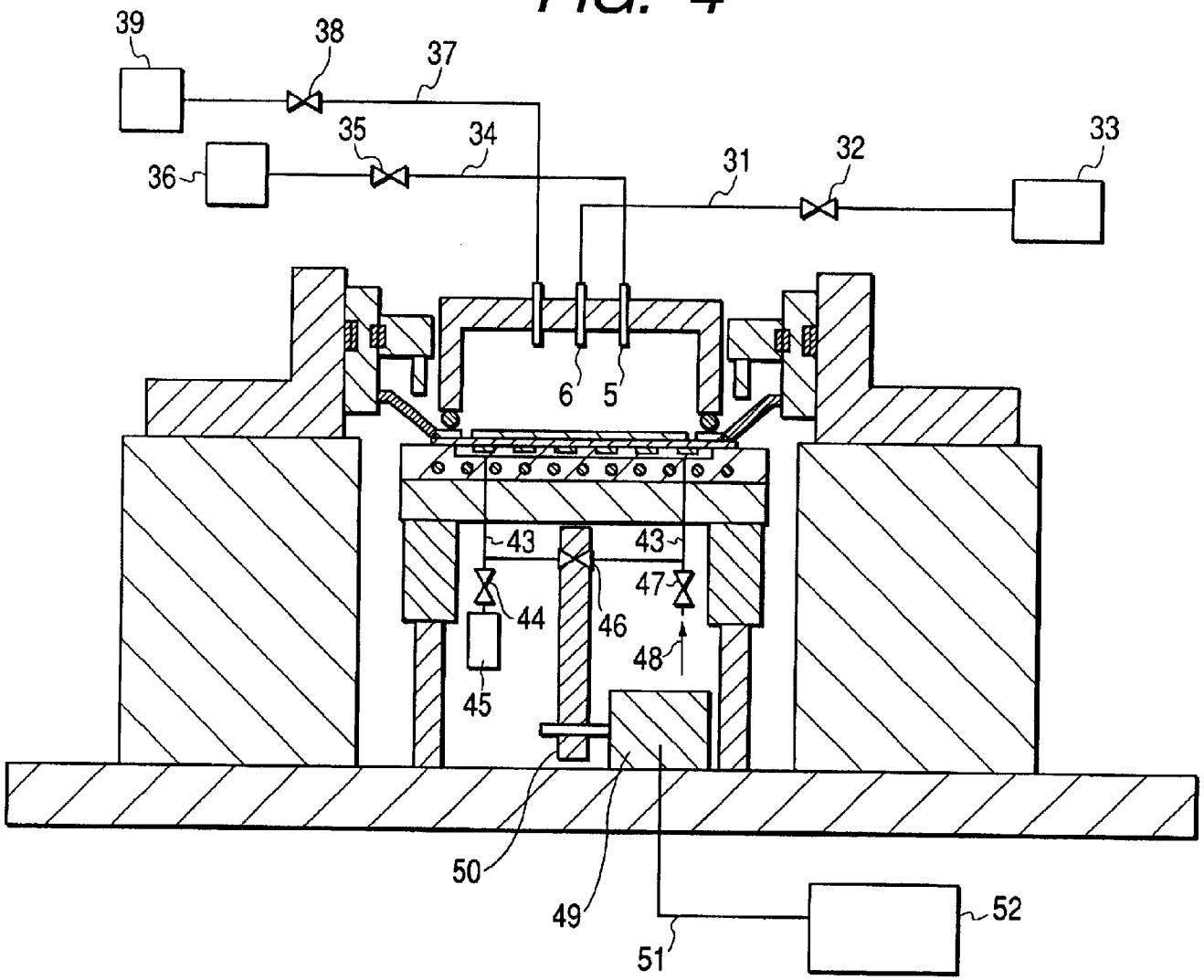
FIG. 4 is a view showing a pipe and circuit in the embodiment of the present invention.
Figure 5:
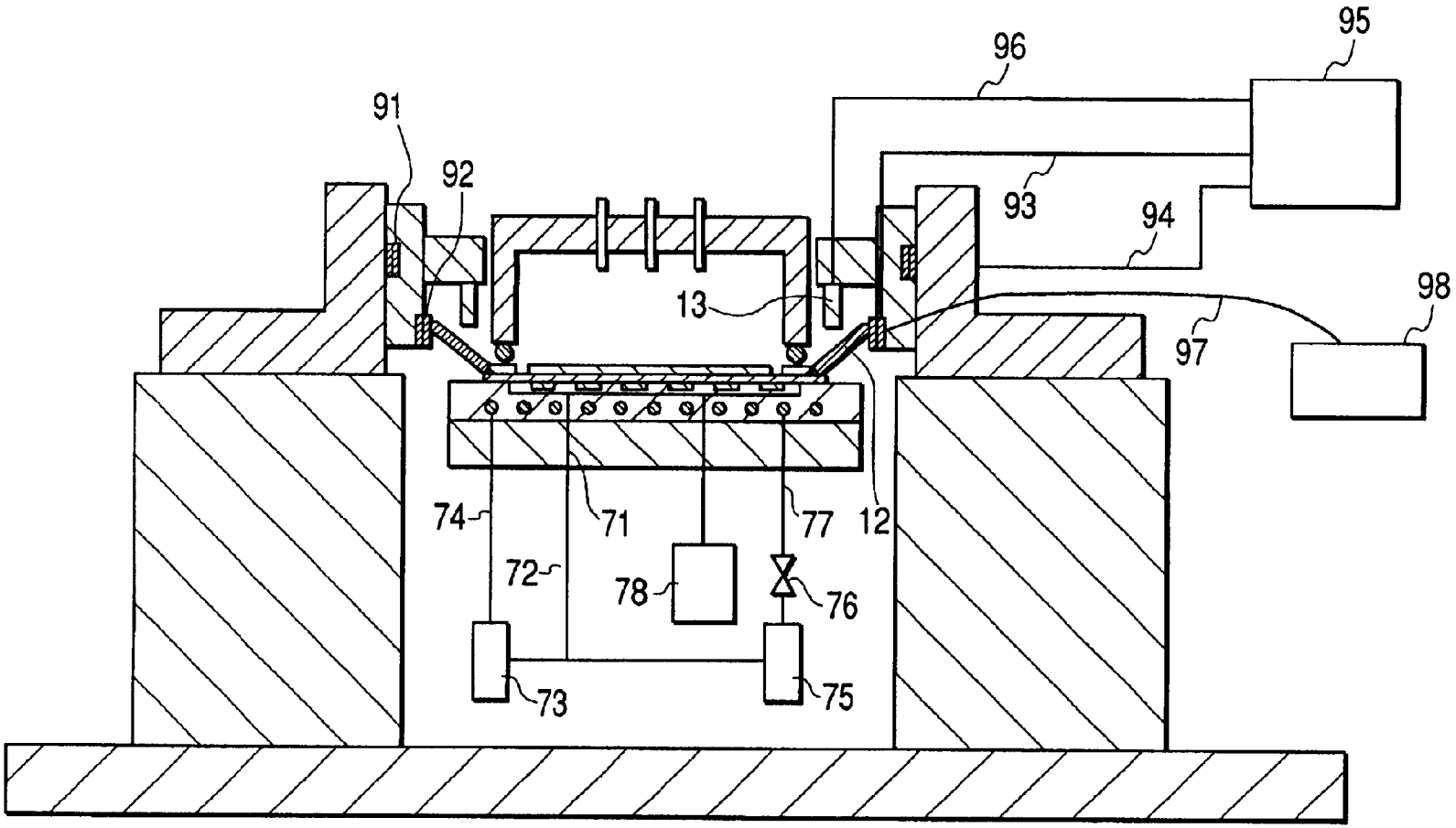
FIG. 5 is a view showing a control circuit in the embodiment of the present invention.
Figure 6:
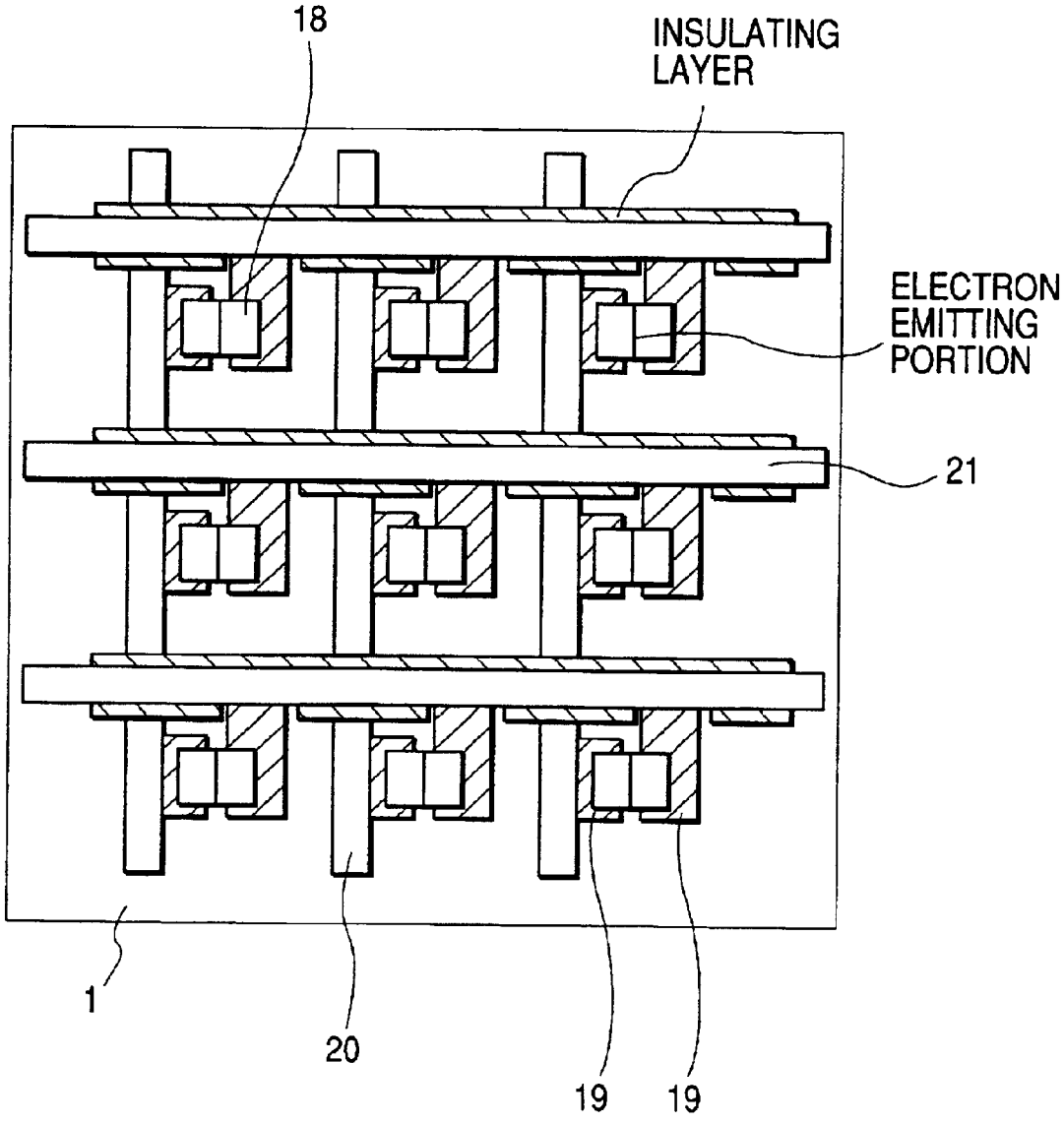
FIG. 6 is a plan view showing an electron source substrate having a plurality of devices in the embodiment of the present invention.

FIGS. 1A to 1C and 2 are schematic views showing an embodiment of the present invention. FIGS. 1A to 1C are schematic views each showing the operation state of a manufacturing apparatus according to the present invention. FIG. 2 is a schematic sectional view mainly showing the main building members of the manufacturing apparatus according to the present invention. FIG. 3 is a schematic view showing a substrate 1 on which a plurality of units (electrodes 19 and conductive films 18) before the "forming step" (to be described later), and wiring lines 20 and 21 connected to apply a voltage to the units are laid out. FIG. 4 is a schematic view mainly showing the piping circuits of the evacuation gas supply system and support driving system of the manufacturing apparatus according to the present invention. FIG. 5 is a view mainly showing the control circuits of the temperature adjustment system and power supply system of the manufacturing apparatus according to the present invention. FIG. 6 is a schematic view showing an electron source substrate having a plurality of electron-emitting devices manufactured by the manufacturing apparatus according to the present invention.

In the present invention, a member made up of a pair of electrodes and a conductive film which connects the electrodes will be referred to as a "conductor" or "unit". The "unit" ("conductor") undergoes the above-described "forming step" or the "forming step" and "activation step" to change the "unit" into an electron-emitting device.

In FIGS. 1A to 1C and 2, the substrate 1 has conductors (units), formed in a region 2 of the substrate 1. The manufacturing apparatus comprises a vessel 4, gas inlet pipes 5, an exhaust pipe 6, a seal member 7, an electrostatic chuck 8, a support 9, a heating means 10, a cooling means 11, probes 12, an alignment camera 13, an alignment unit 14, vacuum chuck holes 15 for vacuum chucking, and helium gas supply pipes 16.

In general, a plurality of "units" are laid out in a matrix on the substrate 1. Thus, the region 2 where the "units" are laid out is substantially rectangular.

Figure 7:
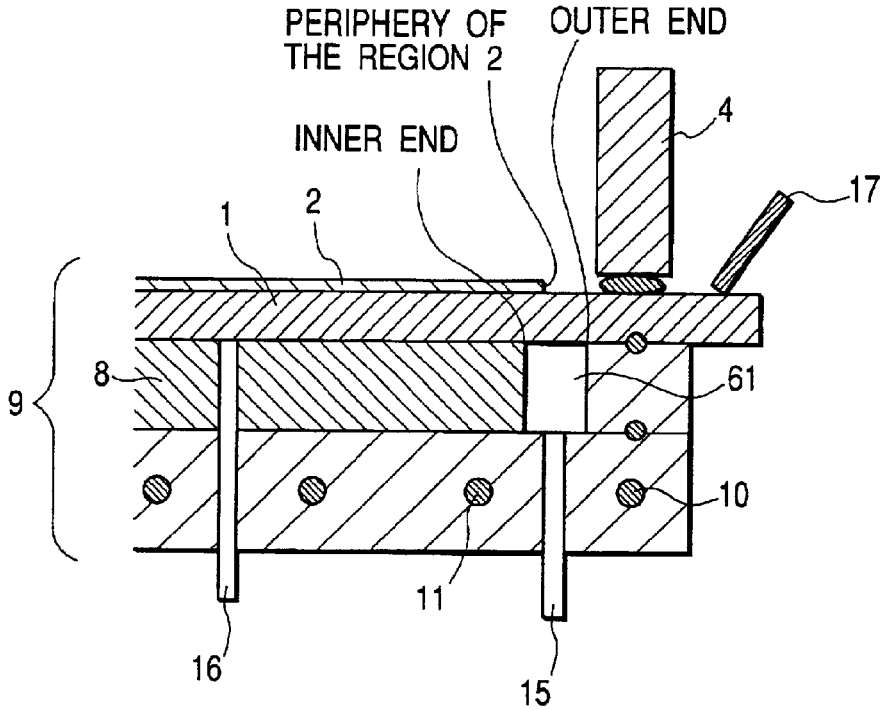
FIG. 7 is a partial sectional view showing the apparatus in the embodiment of the present invention.
Figure 8:
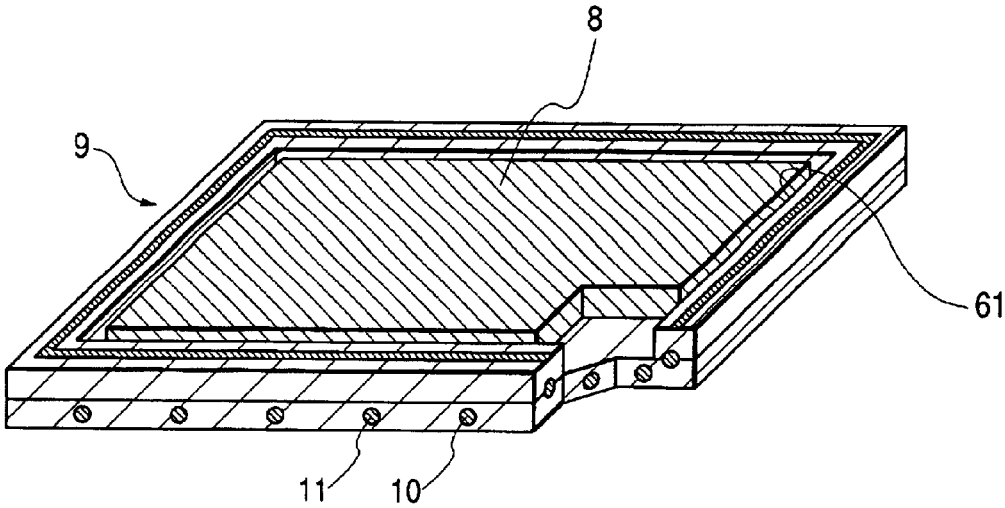
FIG. 8 is a perspective view showing a support in the embodiment of the present invention.

As shown in FIGS. 7 and 8, a gap (groove) 61 is formed in the support 9 (electrostatic chuck 8) of the present invention around the region 2 where conductors (units) are formed. As shown in FIGS. 7 and 8, the groove 61 is formed in a surface of the support 9 that is in contact with the substrate 1 (surface of the substrate 1 opposite to the surface on which units are laid out).

The groove 61 is formed along the periphery (peripheral portion) of the region where conductors (units) are laid out, and thus is substantially rectangularly shaped. Note that the four corners of the rectangular groove 61 need not always have right angles, and may be arcuated.

FIG. 7 is an enlarged view showing the periphery of the support 9 in FIG. 1B, and FIG. 8 is a perspective schematic view showing the support 9.

As shown in FIG. 7, the width of the groove 61 is defined by two ends in substantially contact with the substrate 1. The surface of the substrate 1 has concave and convex shape or warps, so the two ends need not always contact the substrate 1, as shown in FIG. 7.

One end inside the groove 61 is positioned more inward than the periphery of the region where units are laid out. The inner end is positioned more inward by 1 mm or more than the periphery of the region where units are laid out. The inner end is preferably positioned more inward by 2 mm or more than the periphery of the region where units are laid out.

The other end outside the groove 61 is positioned more outward than the region where units are laid out. The outer end is positioned more outward by 10 mm or more than the periphery of the region where units are laid out. The outer end is positioned more inward than the periphery of the substrate 1.

The support 9 supports the electron source substrate 1 and adjusts its temperature. The support 9 comprises a fixing means such as a vacuum chuck mechanism or the electrostatic chuck 8 for fixing the electron source substrate 1, and a temperature control means such as the heating means 10 and/or cooling means 11 for keeping the electron source substrate 1 at a predetermined temperature.

The temperature control means can keep the surface temperature of the electron source substrate 1 at a predetermined temperature in the "forming step" and "activation step". This means has a function of suppressing dehumidification from the surface of the substrate 1 and thermal variations in the electrical processing step ("forming step" and "activation step").

In the present invention, the temperature of the substrate 1 having conductors (units) is controlled in the "activation step" and/or "forming step". This temperature is controlled by the support 9.

If the temperature of the substrate 1 is not controlled, the substrate 1 may be damaged by Joule heat generated along with the "forming step" and "activation step" though it depends on the number of "units" and the material and thickness of the substrate 1. If the substrate 1 is not controlled to a proper temperature, gaps formed in respective units vary in shape, resulting in a low-uniformity electron source.

In the present invention, as shown in FIGS. 7 and 8, the gap (groove) 61 is formed in a portion of the support 9 that corresponds to the periphery of the region where "units" are laid out, in order to suppress the temperature distribution at the periphery of the region where "units" are laid out. This structure can suppress dissipation of heat at the periphery of the region where units are laid out. As a result, a decrease in temperature at the periphery of the region where units are laid out can be suppressed, and the temperature distribution of the region where units are laid out can be made more uniform.

The vessel 4 is made of stainless steel, titanium, or glass, and is desirably formed from a material which hardly discharges gas from the vessel. The vessel 4 covers the region 2 of the substrate 1 where units are formed, and at least the interior of the vessel 4 can stand a pressure of $1\times10^{-4}$ Pa to atmospheric pressure. Thus, the space defined by the vessel 4 and the substrate 1 having units can be maintained in a depressurized state.

The seal member 7 disposed at the joint portion between the vessel 4 and the substrate 1 holds the airtightness between the substrate 1 and the vessel 4, and is an O-ring or rubber sheet. The seal member 7 is in contact with the substrate 1 outside the region 2 where a plurality of units are laid out. Note that the seal member 7 is also in contact with the substrate 1 on the wiring lines 20 and 21 (see reference numeral 3 in FIG. 3).

As shown in FIG. 3, "extracted wiring lines" in the present invention are part (ends) of the wiring lines 20 and 21 for connecting units (each made up of the pair of electrodes 19 and the conductive film 18) to an external power supply, and are located in a region (air-exposed region) outside the space defined by the vessel 4 and substrate 1.

The exhaust pipe 6 is connected to a vacuum pump 33 via a pipe shown in FIG. 4, and evacuates the space defined by the vessel 4 and substrate 1. The gas inlet pipe 5 is used to introduce predetermined gas into the space defined by the vessel 4 and substrate 1. The introduced gas includes an organic substance used for the "activation step" and hydrogen gas used for the "forming step".

The probes 12 are located outside the vessel 4, and are connected to wiring lines (extracted wiring lines) exposed to air. The extracted wiring lines are part of the wiring lines 20 and 21 in FIG. 3, and are particularly the wiring lines 20 and 21 at positions (outside the region 3) where they are exposed to air when the vessel 4 covers the substrate 1. The probes 12 are fixed to the probe unit 14, and the probe unit 14 has the camera 13 for alignment. The camera 13 reads the position of an alignment mark on the substrate 1, and the position of the probe unit 14 is aligned to the position of the substrate 1 so as to make the probes 12 reliably contact the extracted wiring lines exposed to air.

In FIG. 4, the manufacturing apparatus comprises a pipe 31, a valve 32, a vacuum pump 33, an activation gas supply pipe 34, an activation gas valve 35, an activation gas cylinder 36, a forming gas supply pipe 37, a forming gas supply valve 38, a forming gas cylinder 39, pipes 43 for chuck evacuation and gas introduction, a valve 44, a vacuum pump 45, a selector valve 46, a valve 47, a gas supply source 48 for helium gas or the like, a support elevation driving motor 49, a support elevation power transmission shaft 50, an electrical line 51 to the support elevation driving motor 49, and a support elevation driving motor controller 52.

In FIG. 5, the manufacturing apparatus comprises a sensor 71 for measuring the temperature of the support 9, a temperature signal line 72, a heater controller 73, a wiring line 74 which connects a heater and the heater controller 73, a cooling water supply controller 75, a cooling water pipe 76, a valve 77, a voltage application source 78 to the electrostatic chuck, an elevation actuator 91 of the probe alignment unit, a probe alignment actuator 92, an actuator driving controller 95, wiring lines 93 and 94 which connect the actuators 91 and 92 to the actuator driving controller, a signal line 96 extending from the alignment mark reading camera 13, a driver 98, and a wiring line 97 which connects the driver 98 to the probe 12.

An example of an electron source manufacturing method using the manufacturing apparatus with the above arrangement will be described with reference to FIGS. 1A, 1B and 1C to FIG. 5.

The glass substrate 1 (FIG. 3) whose surface has a plurality of conductors (units each made up of the conductive film 18 and the pair of electrodes 19) and the X- and Y-direction wiring lines 20 and 21 connected to the conductors is set on the support 9.

The conductive film is a thin film made of a conductive material such as Ni, Au, PdO, Pd, or Pt. In FIG. 3, the seal member 7 disposed between the vessel 4 and the substrate 1 is in contact with the substrate 1 in the region 3.

The temperature sensor 71 measures the temperature near the surface of the support 9, and the heater controller 73 and heating means 10 control the temperature of the support 9 so as to adjust it to a desired temperature (first temperature).

At this time, the valves 44 and 46 are opened, and the valve 47 is closed. The substrate 1 is vacuum-chucked from the vacuum chuck holes 15 via the pipes 43, and tightly contacts the surface of the support 9. The electrostatic chuck 8 receives a voltage from the voltage application source 78, and the substrate 1 is electrostatically chucked to the surface of the electrostatic chuck (FIG. 1A).

The support elevation driving motor controller 52 supplies a signal to the support elevation driving motor 49, and the support elevation power transmission shaft 50 moves up the support 9. When the support 9 moves up, the upper surface of the substrate 1 comes into contact with the seal member 7 of the vessel 4 (FIG. 1B).

The probes 12 and the wiring lines 20 and 21 are connected as follows.

The alignment camera 13 reads an alignment mark on the surface of the substrate 1, and the actuator driving controller 95 calculates the positions of extracted wiring lines on the substrate 1. Based on the calculated values, the actuator driving controller 95 moves the probe alignment actuator 92 via the actuator wiring line 94. The position of the alignment unit is adjusted in the X and Y directions so as to position the distal ends of the probes 12 onto the extracted wiring lines.

A signal is sent to the elevation actuator 91 of the probe alignment unit, the probe unit moves down in the Z direction, and the extracted wiring lines and the distal ends of the probes 12 come into contact with each other.

The evacuation valve 32 is opened, and the vacuum pump 33 evacuates the space defined by the vessel 4 and substrate 1 to a desired vacuum degree (e.g., $1\times10^{-4}$ Pa or more) via the pipe 31 connected to the exhaust pipe 6.

When the conductive film is made of an oxide, the forming gas supply valve 38 is opened, and the forming gas cylinder 39 supplies hydrogen to the space defined by the vessel 4 and substrate 1 via the pipe 37 connected to the gas inlet pipe 5. When the conductive film is not made of an oxide, no forming gas (hydrogen) is introduced.

The "forming step" of supplying a current from the driver 98 to the probes 12 and applying a voltage (preferably a pulse voltage) to respective units via the X- and Y-direction wiring lines 20 and 21 is performed. By the "forming step", a gap is formed in the conductive film 18 which forms each unit. The "forming step" ends when a current flowing through the conductive film 18 is measured to detect a sufficiently high resistance (e.g., 1 MΩ or more).

Then, the valve 38 is closed, the vacuum valve 32 is opened, and the space defined by the vessel 4 and substrate 1 is evacuated.

The activation gas valve 35 is opened, and the activation gas cylinder 36 supplies carbon compound gas such as organic gas into the space defined by the vessel 4 and substrate 1 via the pipe 34 connected to the gas inlet pipe 5. At this time, while the gas pressure adjusting unit adjusts the supplied gas pressure, the gas pressure in the space defined by the vessel 4 and substrate 1 is maintained at a desired pressure (e.g., $1\times10^{-4}$ Pa). At this time, the temperature of the support 9 is set to one set in the forming step.

Then, the "activation step" is performed by starting voltage application to respective units via the X- and Y-direction wiring lines 20 and 21 from the probes 12 using the driver 98. By the "activation step", a carbon film is formed in the gap formed by the "forming step" and on the conductive film near the gap. The "activation step" ends when a current flowing through a pair of electrodes which constitute each unit reaches a desired value.

By this step, each unit changes into an electron-emitting device, completing an electron source substrate (FIG. 6).

During the "activation step", the heater controller 73 and the heating means 10 or cooling means 11 control the temperature of the support 9 so as to adjust it to a desired temperature (second temperature) while the temperature sensor 71 measures the surface temperature of the support 9.

After the "activation step", the probes 12 are moved apart from the extracted wiring lines. The activation gas valve 35 is closed, and the activation gas in the vessel is exhausted.

The support elevation driving motor controller 52 supplies a signal to the support elevation driving motor 49, and the support elevation power transmission shaft 50 moves down the support 9 to move the substrate 1 apart from the seal member 7 of the vessel 4.

Finally, the electron source substrate 1 having many electron-emitting devices is extracted from the surface of the support 9.

The electron source substrate 1 manufactured by using the above-described apparatus shown in FIG. 7, and a face plate having phosphors and anode electrodes are sealed via a frame member and spacers with a bonding agent such as frit glass, thereby completing an image-forming apparatus.

In the present invention, if the "forming step" and "activation step" are executed while the probes 12 are in contact with the extracted wiring lines of the substrate 1, each unit (conductor) generates heat. If Joule heat generated by each unit during the "forming step" or "activation step" varies, the electron-emitting characteristics of formed electron-emitting devices vary or are adversely affected. To prevent this, the surface temperature of the substrate 1 must be held as constant as possible. In the present invention, therefore, the temperature of the substrate 1 is controlled by controlling that of the support 9 in the "forming step" and "activation step".

In the present invention, the temperatures of the substrate 1 and support 9 are adjusted lower than a set temperature (first or second temperature) in the "forming step" and "activation step". In this state, the probes 12 are brought into contact with the extracted wiring lines, and the "forming step" or "activation step" starts. At the same time, the temperature of the support 9 is controlled to adjust that of the substrate 1 to the first or second temperature.

This manufacturing process of the present invention can suppress misalignment between the relative positions of the extracted wiring line of the substrate 1 and the distal end of the probe 12 in the "forming step" and "activation step".

If the extracted wiring lines are brought into contact with the probes 12 at room temperature without adjusting the temperature of the substrate 1 by the above method, and the "forming step" or "activation step" is performed while the temperature is controlled, the relative positions of the extracted wiring line of the substrate 1 and the distal end of the probe 12 may be misaligned owing to thermal expansion or contraction of the substrate 1. With a large misalignment amount, the probes 12 may move apart from the extracted wiring lines, failing in the "forming step" or "activation step".

However, the manufacturing process of the present invention can suppress variations in the relative positions of the probe and extracted wiring line caused by changes in shape along with thermal expansion or contraction of the substrate 1. As a result, a high-uniformity electron-emitting device and electron source can be stably formed.

The manufacturing method using the manufacturing apparatus of the present invention can greatly shorten the time taken for the "forming step" and "activation step" and can easily form a high-uniformity electron source and image-forming apparatus.

EXAMPLE 1

Figure 9:
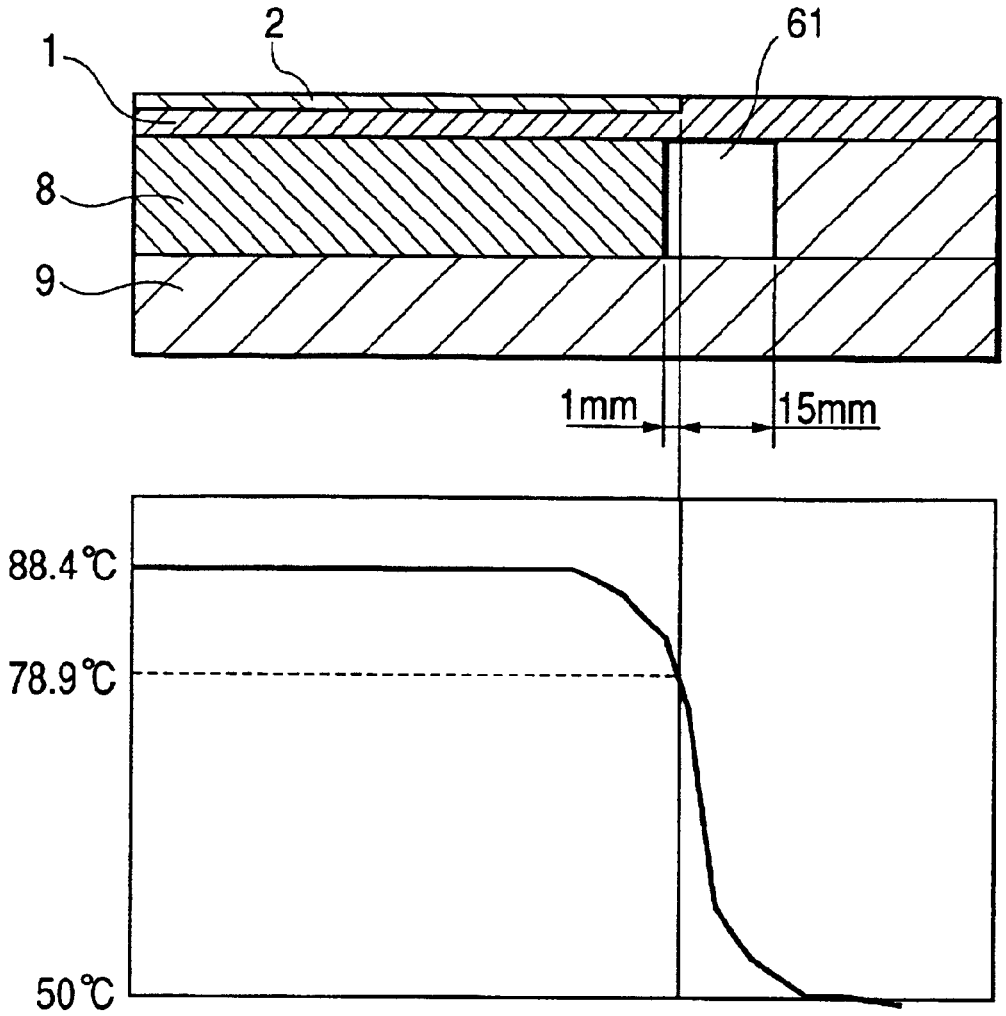
FIG. 9 is a view showing Example 1 in the embodiment of the present invention.

In Example 1, the size of a gap 61 formed in a support 9 (side of an electrostatic chuck 8) was defined by an outer side corresponding to 15 mm from the outside and an inner side corresponding to 1 mm inward from the periphery of a region 2 where a plurality of units were formed, as shown in FIG. 9.

With this electron source manufacturing apparatus, the temperature distribution of the region where a plurality of units were formed was 9.5° C. during the "activation step", and a high-uniformity electron-emitting device was manufactured.

EXAMPLE 2

In Example 2, the schematic arrangement and components of the apparatus were the same as those in Example 1. The size of a gap 61 formed in an electrostatic chuck 8 was defined by an outer side corresponding to 15 mm from the outside and an inner side corresponding to 2 mm inward from the periphery of a region 2 where a plurality of units were formed, as shown in FIG. 10.

Figure 10:
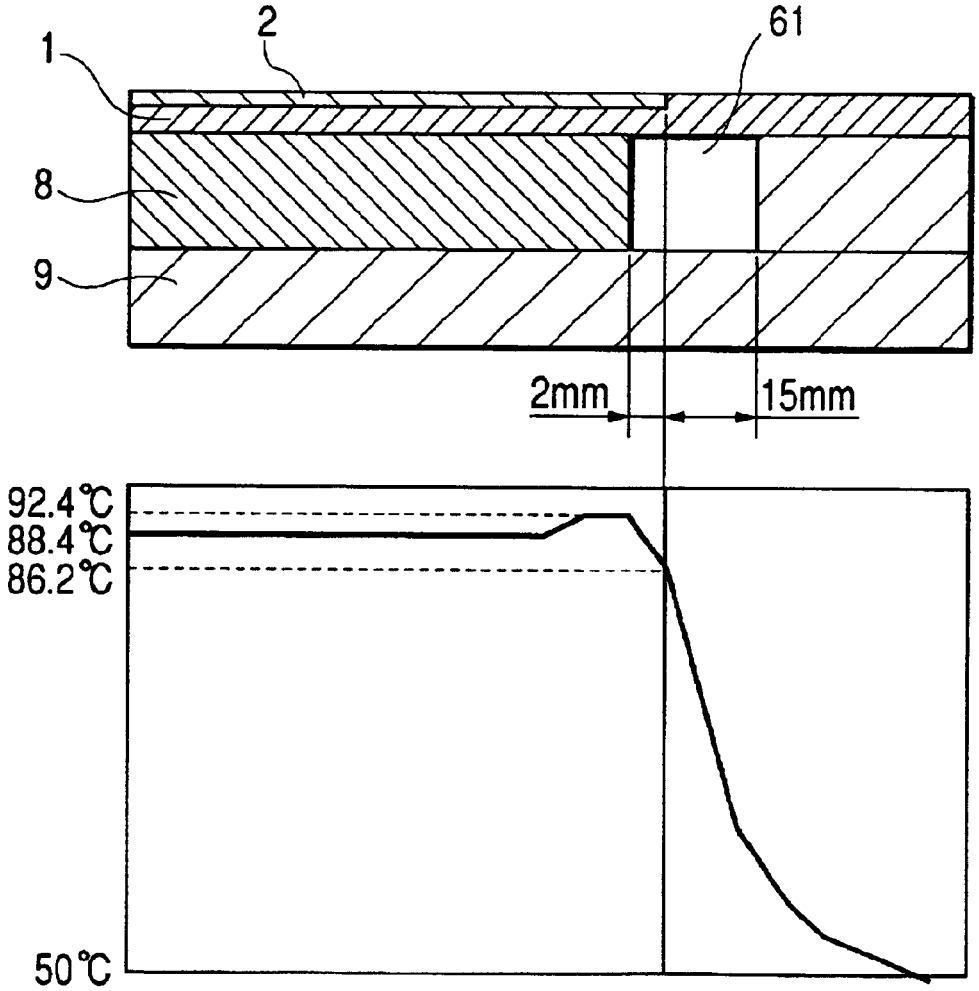
FIG. 10 is a view showing Example 2 in the embodiment of the present invention.

With this electron source manufacturing apparatus, the temperature distribution of the region where a plurality of units were formed was 6.2° C. during the "activation step", as shown in FIG. 10. The uniformity of the electron-emitting characteristics of the electron source substrate manufactured in Example 2 was equal to or higher than that in Example 1.

EXAMPLE 3

In Example 3, the schematic arrangement and components of the apparatus were the same as those in Example 1. The size of a gap 61 formed in an electrostatic chuck 8 was defined by an outer side corresponding to 25 mm from the outside and an inner side corresponding to 1 mm inward from the periphery of a region 2 where a plurality of units were formed, as shown in FIG. 11.

Figure 11:
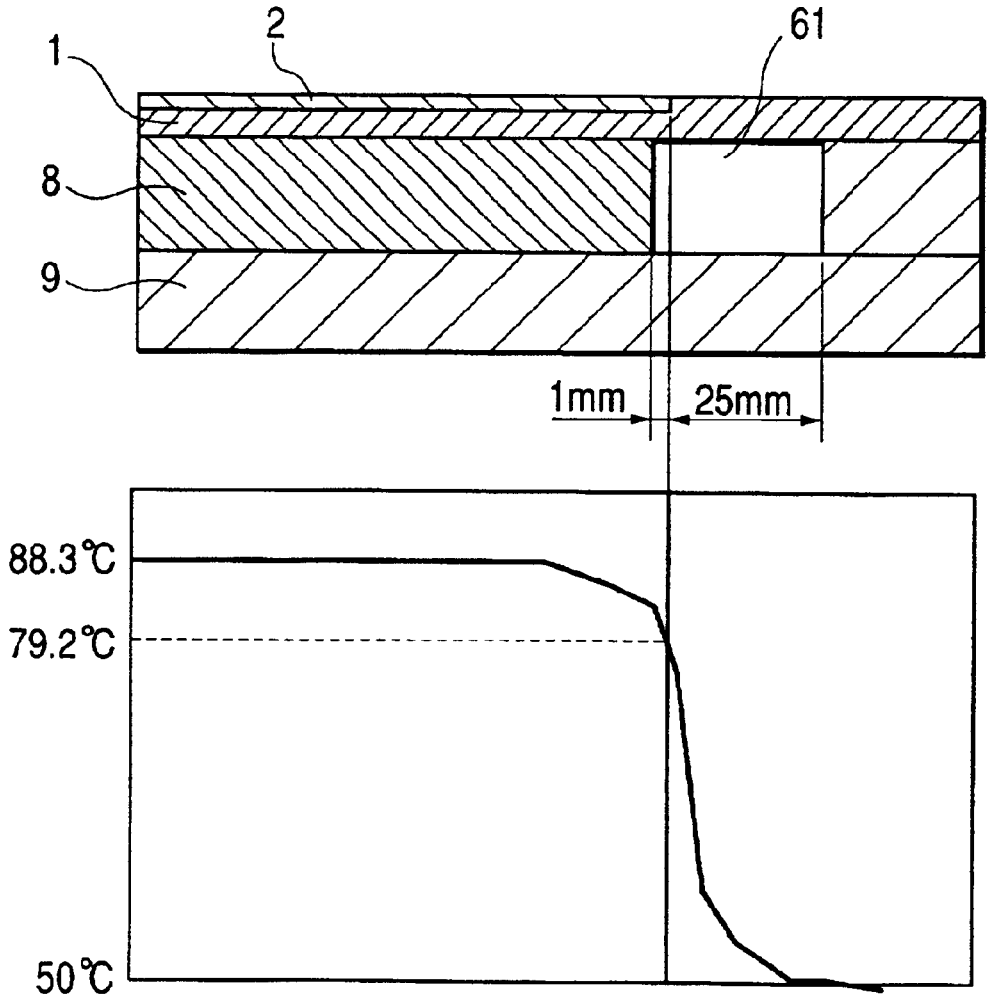
FIG. 11 is a view showing Example 3 in the embodiment of the present invention.

With this electron source manufacturing apparatus, the temperature distribution of the region where a plurality of units were formed was 9.1° C. during the "activation step", as shown in FIG. 11. The uniformity of the electron-emitting characteristics of the electron source substrate manufactured in Example 3 was equal to or higher than that in Example 1.

EXAMPLE 4

In Example 4, the schematic arrangement and components of the apparatus were the same as those in Example 1.

Figure 12:
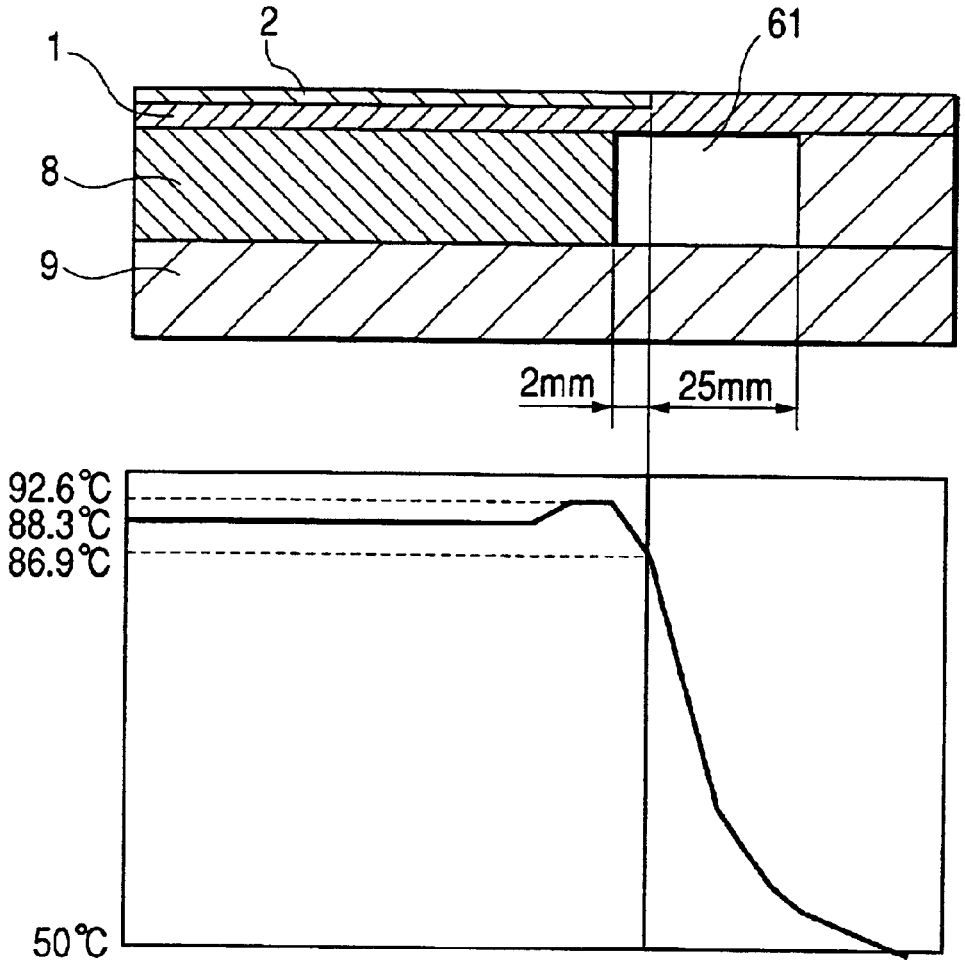
FIG. 12 is a view showing Example 4 in the embodiment of the present invention.

The size of a gap 61 formed in an electrostatic chuck 8 was defined by an outer side corresponding to 25 mm from the outside and an inner side corresponding to 2 mm inward from the periphery of a region 2 where a plurality of units were formed, as shown in FIG. 12.

With this electron source manufacturing apparatus, the temperature distribution of the region where a plurality of units were formed was 5.7° C. during the "activation step", as shown in FIG. 12. The uniformity of the electron-emitting characteristics of the electron source substrate manufactured in Example 4 was equal to or higher than that in Example 1.

EXAMPLE 5

Each of the electron source substrates manufactured in Examples 1 to 4 was positioned to face a transparent substrate having phosphors and anodes (metal back) for accelerating electrons emitted by electron sources, and a display in which the interior is maintained at a vacuum degree of about $10^{-8}$ Torr was assembled. Four displays (image-forming apparatuses) fabricated in Example 5 exhibited uniform display images and could maintain stable images for a long time.

Comparative Example

Figures 13, 14:
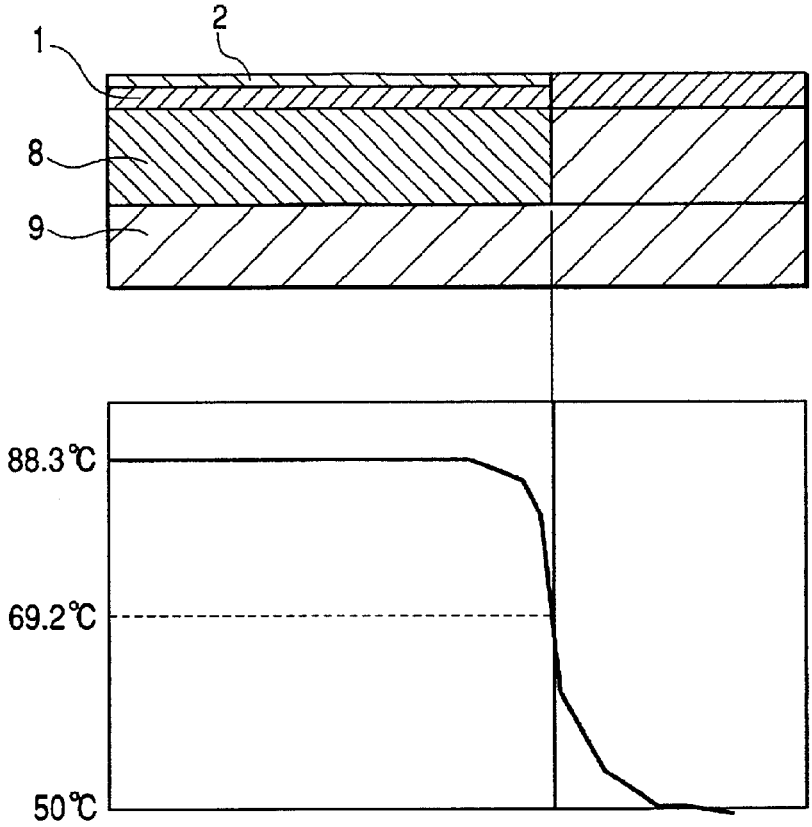
FIG. 13 is a view showing a comparative example to the present invention.
FIG. 14 is a table showing the results of the respective examples and comparative example in the present invention.

In the comparative example, the schematic arrangement and components of the apparatus were the same as those in Example 1. As shown in FIG. 13, no gap was formed in a support 9 (side of an electrostatic chuck 8).

With this electron source manufacturing apparatus, the temperature distribution of the region where a plurality of units were formed was 19.1° C. during the "activation step", as shown in FIG. 13. The uniformity of the electron source substrate was lower than that of the electron source substrate formed in Example 1. The electron source manufactured by using the apparatus of the comparative example may loose the electrical contact between a probe 12 and an extracted wiring line due to deformation of the substrate.

FIG. 14 shows the results of the respective examples and comparative example.

As has been described above, the present invention can provide an electron source manufacturing apparatus which can be easily downsized and operated. The present invention can provide an electron source manufacturing method which can increase the manufacturing speed and is suitable for mass production. The present invention can provide an electron source manufacturing apparatus and manufacturing method capable of manufacturing an electron source excellent in electron-emitting characteristics. Furthermore, the present invention can provide an image-forming apparatus excellent in image quality.

What is claimed is:

1. An electron source manufacturing apparatus comprising:

(a) a support having a fixing member and having a groove on its surface, which supports a substrate having a conductor formed thereon, (b) a vessel which has a gas inlet port and a gas exhaust port and covers part of the substrate;

(c) a gas controller for introducing and exhausting gas into and from said vessel; and (d) a voltage applier for applying a voltage to the conductor, wherein the groove is arranged along a periphery of the fixing member.

2. An electron source manufacturing apparatus comprising:

(a) a support having a fixing member and having a groove on its surface, which supports a substrate having a conductor comprising a plurality of units each comprising a pair of electrodes and a conductive film formed between the electrodes;

(b) a vessel which covers part of the substrate;

(c) a gas controller for introducing and exhausting gas into and from a space defined by said vessel and the substrate; and (d) a voltage applier for applying a voltage to each conductor, wherein the groove is arranged so as not to be overlapped with the fixing member and so as to surround the fixing member.

3. An electron source manufacturing apparatus comprising:

(a) a support having a fixing member and having a groove on its surface, which supports a substrate having a conductor formed thereon;

(b) a vessel which covers part of the substrate and which forms a space including the conductor, wherein the space is defined by the vessel and the substrate; and (c) a voltage applier for applying a voltage to the conductor, wherein the groove and the fixing member are arranged side-by-side, and the groove is arranged so that the fixing member is surrounded by the groove.

4. An apparatus according to any one of claims 1–3, in which the groove is substantially rectangular.

5. An apparatus according to any one of claims 1–3, in which an inner end of the groove is located not less than 1 mm inward from a periphery of the conductor.

6. An apparatus according to any one of claims 1–3, in which an outer end of the groove is located not less than 10 mm outward from a periphery of the conductor.

7. An electron source manufacturing apparatus comprising:

(a) a support having a fixing member and having a groove on its surface, which supports a substrate having a conductor formed thereon; and (b) an exhaust device for depressurizing an inside of the groove, wherein the groove and the fixing member are arranged side-by-side and the groove is arranged so that the fixing member is surrounded by the groove.

8. An apparatus according to any one of claims 1–3 and 7, wherein said fixing member is an electrostatic chuck.

9. An electron source manufacturing apparatus comprising:

a support having a fixing member and having a groove on its surface, which supports a substrate having a conductor formed thereon, wherein the groove is arranged along a periphery of the fixing member.

10. An electron source manufacturing apparatus comprising:

a support having a fixing member and having a groove on its surface, which supports a substrate having a conductor formed thereon, wherein the groove is arranged so as not to be overlapped with the fixing member and so as to surround the fixing member.

11. An electron source manufacturing apparatus comprising:

a support having a fixing member and having a groove on its surface, which supports a substrate having a conductor formed thereon, wherein the groove and the fixing member are arranged side-by-side, and the groove is arranged so that the fixing member is surrounded by the groove.

12. An electron source manufacturing apparatus comprising:

a support having a fixing member and having a groove on its surface, which supports a substrate having a conductor formed thereon, wherein an inner end of the groove is located not less than 1 mm inward from a periphery of the conductor.

13. An electron source manufacturing apparatus comprising:

a support having a fixing member and having a groove on its surface, which supports a substrate having a conductor formed thereon, wherein an outer end of the groove is located not less than 10 mm outward from a periphery of the conductor.

14. An electron source manufacturing apparatus comprising:

a support having a fixing member and having a groove on its surface, which supports a substrate having a conductor formed thereon, wherein an inner end of the groove is located not less than 1 mm inward from a periphery of the conductor and an outer end of the groove is located not less than 10 mm outward from the periphery.

15. A method for manufacturing an electron source comprising:

operating an apparatus for manufacturing an electron source according to any one of claims 1–3, 7 and 9–14.

16. A method for manufacturing an electron source for a display device comprising:

manufacturing the electron source employing an apparatus for manufacturing an electron source according to any one of claims 1–3, 7 and 9–14.

* * * * *